US005236217A

United States Patent [19]

Provence

[11] Patent Number: 5,236,217

[45] Date of Patent: Aug. 17, 1993

[54] GUIDING RIB FOR A CROSS-COUNTRY SKI BOOT

[75] Inventor: Marc Provence, Thorens Les Glieres, France

[73] Assignee: Salomon S.A., Annecy Cedex, France

[21] Appl. No.: 592,273

[22] Filed: Oct. 3, 1990

[30] Foreign Application Priority Data

Oct. 4, 1989 [FR] France ..... 89 13231

[51] Int. Cl.[5] ..... A63C 5/00

[52] U.S. Cl. ..... 280/615; 280/809

[58] Field of Search ..... 280/614, 615, 607, 608, 280/609, 610, 809, 813

[56] References Cited

U.S. PATENT DOCUMENTS

| | | | |
|---|---|---|---|
| 3,284,091 | 11/1966 | Spier | 280/813 |
| 3,826,518 | 7/1974 | Hennig | 280/813 |
| 3,976,304 | 8/1976 | Lillibridge et al. | 280/813 |
| 4,409,287 | 10/1983 | Harrison | 428/343 |
| 4,487,427 | 12/1984 | Salomon | 280/615 |

FOREIGN PATENT DOCUMENTS

| | | |
|---|---|---|
| 386128 | 7/1988 | Austria . |
| 283331 | 9/1988 | European Pat. Off. . |
| 3628292 | 2/1987 | Fed. Rep. of Germany . |
| 2623094 | 5/1989 | France . |
| 2647165 | 11/1990 | France . |

*Primary Examiner*—Richard M. Camby
*Attorney, Agent, or Firm*—Sandler Greenblum & Bernstein

[57] ABSTRACT

A guiding rib for a cross-country ski boot having at least one support surface on which is placed an adhesive covered by a protection sheet arranged on the adhesive and overhangs the adhesive. The guiding rib has at least one transverse groove constituting zones of lesser resistance permitting the breaking of the rib. The adhesive includes a transverse indentation coinciding with each of the transverse grooves of the rib. The protective sheets also include transverse indentations coinciding with the indentations of the adhesive, but are interrupted in the projecting part of the sheets to preserve a continuous part of each protective sheet.

12 Claims, 5 Drawing Sheets

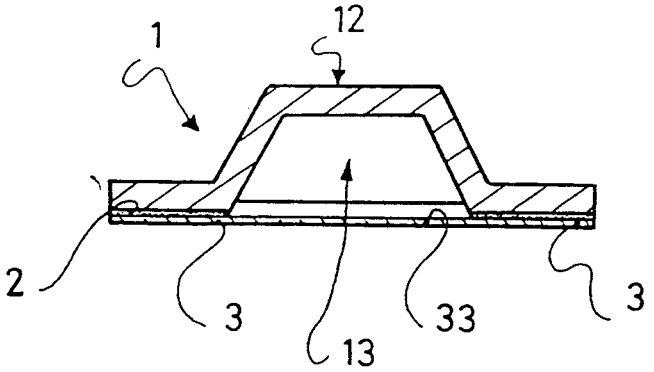
FIG: 4
FIG: 5
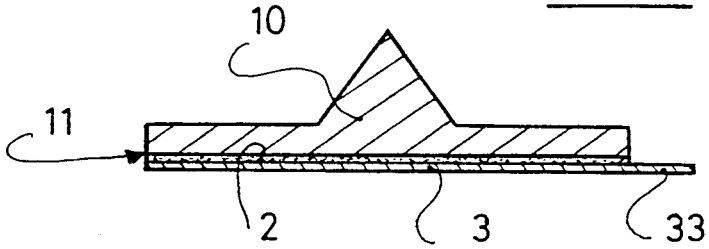
FIG: 6
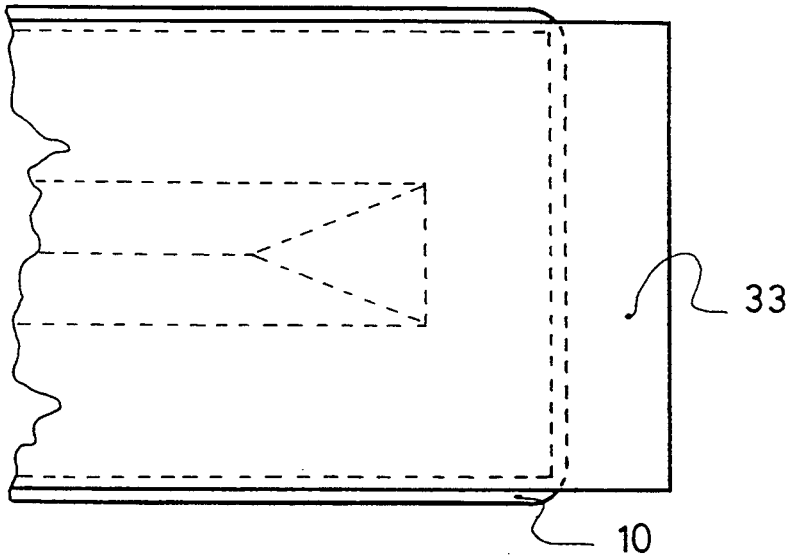
FIG: 7
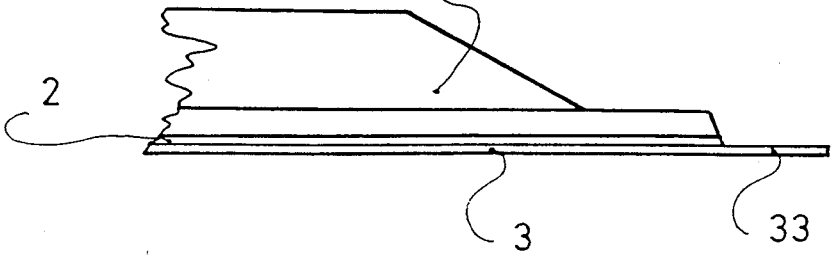

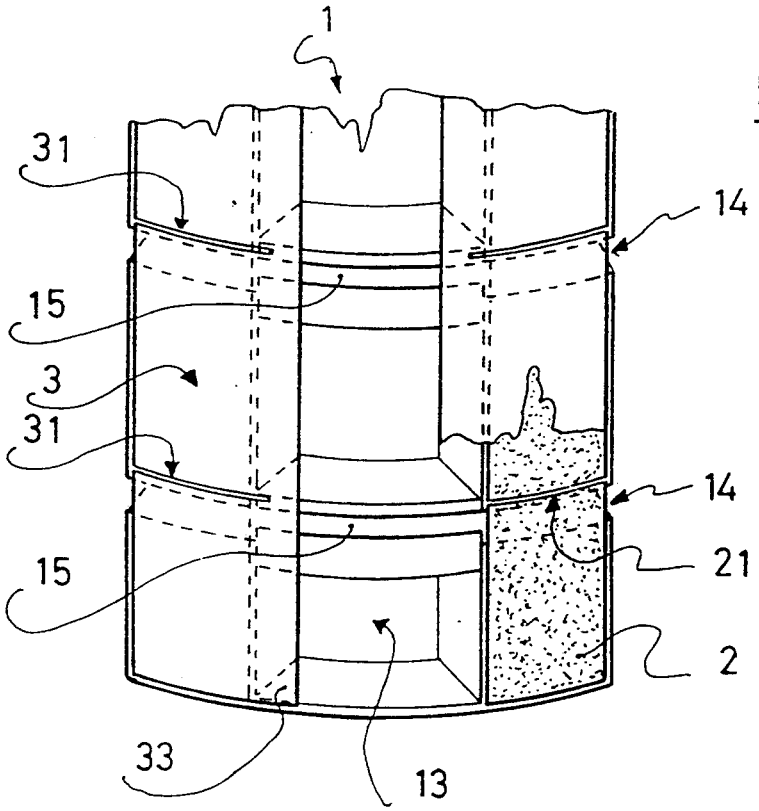
FIG : 8
FIG : 9
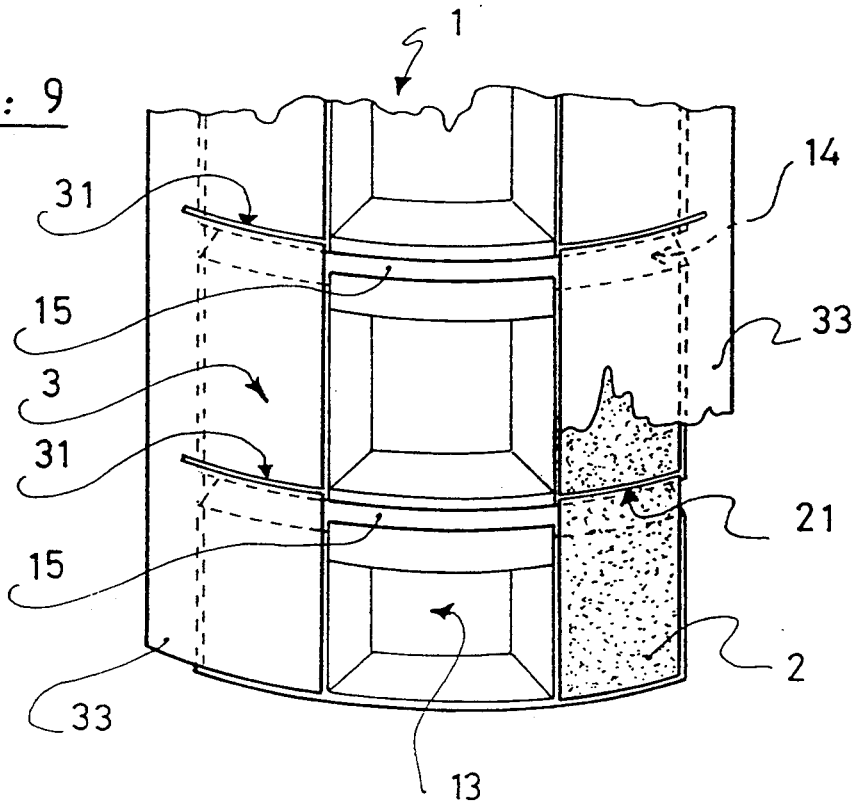

GUIDING RIB FOR A CROSS-COUNTRY SKI BOOT

BACKGROUND OF THE INVENTION

1. Field of the Invention

The present invention concerns the attachment of a lateral guiding device, such as a guiding rib, of a cross-country ski boot on a ski.

2. Description of Background and Other Information

The assembly of such a rib on a ski is traditionally done with a pin and a screw. This method presents the advantage of being inexpensive and is sufficient to maintain the rib on the ski. However, this type of assembly has the drawback of not pressing the rib uniformly along the entire surface of the ski.

It has been was proposed (SALOMON French Patent No. 2,647,165) to position this rib by using a prepositioned pin to also aid in the attachment of the rib. It is then possible to attach the rib to the ski by an adhesive strip with a protective sheet, placed on each support surface of the rib. Such a placement technique creates certain problems relative to the adhesive strip and particularly the removal of its protective sheet.

Also, French Patent No. 2,623,094 discloses a guiding rib furnished with transverse grooves constituting a zone of lesser resistance and permitting a shortening of this rib to adapt to different shoe sizes.

In such a rib, called divisible, providing adhesive, poses the problem of obtaining a "clean" cut of the adhesive at the position of the rib rupture zone, that is, a cut which does not retract or project the adhesive.

SUMMARY OF THE INVENTION

An object of the present invention is to remedy these drawbacks and to furnish a guiding rib of the type including at least one support surface intended to be applied against the upper surface of the ski, which solves the problems cited above concerning the placing of the rib, the removal of the protective sheet and the rupture of the rib.

This object is attained in the guiding rib according to the invention by the fact that it includes adhesive on its support surface and this adhesive is covered, before being installed on the guiding rib of the ski, by at least one protective sheet arranged to project beyond the adhesive.

In effect, the projection of the protective sheet facilitates handling by the user, and thus facilitates its removal.

In the case of a solid guiding rib, its protective sheet will be advantageously arranged to extend towards the exterior of the guiding rib.

In the case of a rib with at least one hollow part, the protective sheet will advantageously be arranged to protrude inside of the hollow part, such an arrangement avoiding any overhang towards the exterior by this protective sheet.

In the case of a divisible rib including at least one transverse groove constituting a zone of lesser resistance for the shortening of this rib, the adhesive located at the position of each transverse groove includes a transverse indentation extending essentially along the entire length of the transverse groove.

Such an indentation permits a clean cut of the adhesive when the rib breaks and thus permits the avoidance of any undesirable retraction or projection of the adhesive.

According to a preferred embodiment, the protective sheet for the adhesive includes a transverse indentation coinciding with the indentation of the adhesive an this indentation is interrupted in the projecting part of the protective sheet, which permits one part of the protective sheet to be continuous and facilitates the removal of this protective sheet.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIGS. 3 and 4 are transverse sections of the guiding rib according to variations of construction of the invention;

FIG. 5 is a transverse section of a solid guiding rib;

FIG. 6 is a view from below of the solid guiding rib according to another embodiment;

FIG. 7 is a side view of the guiding rib in FIG. 6;

FIG. 8 is a view from below of the guiding rib represented in FIG. 1;

FIGS. 9 and 10 are views from below of variations of execution of the guiding rib according to the invention;

DETAILED DESCRIPTION OF PREFERRED EMBODIMENTS

Figure 1:
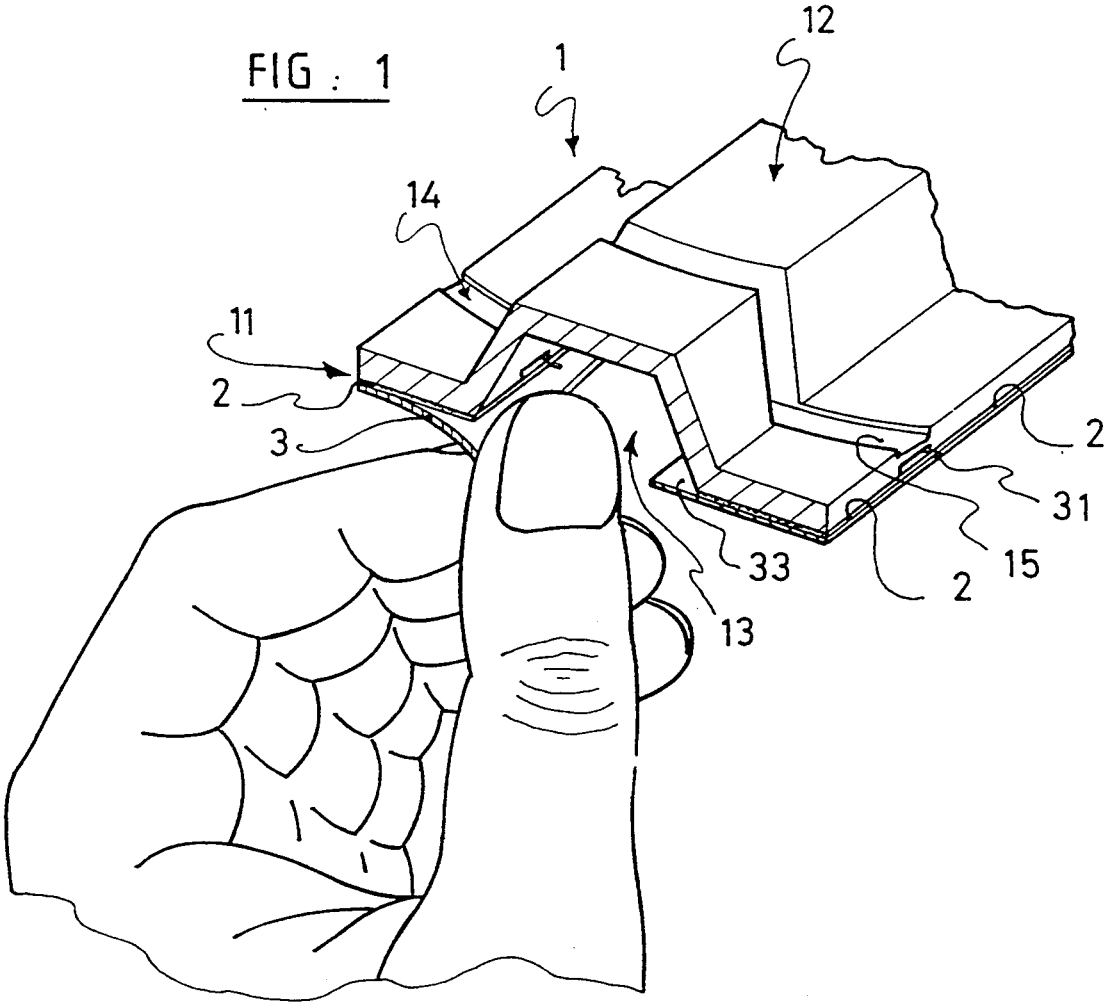
FIG. 1 is a partial view in perspective of a guiding rib according to the invention.

FIG. 1 represents a lateral guiding rib 1 of a cross-country ski boot (not shown in the, drawing), of a type known in the art and described in French Patent Application No. 87.15950. This guiding rib 1 includes two lateral support surfaces 11 which are intended to be applied on the upper surface of the ski, and a central projecting part 12 which is intended to guide the boot.

The adhesive means 2 are applied on each of the support surfaces 11 and are each constituted of a double faced adhesive strip according to the preferable construction, but they could also be made of a film of glue. These adhesive means 2 permit the guiding rib 1 to be assembled and uniformly attached to the ski.

Each of the adhesive means 2 is covered by a protective sheet 3, which is constituted of a paper strip or a plastic film, which is intended to be removed before the guiding rib is placed on the ski.

These protective sheets 3 permit the adhesive means 2 to remain clean from when they are placed on the guiding rib 1, to when guiding rib 1 is applied on the ski.

Figure 2:
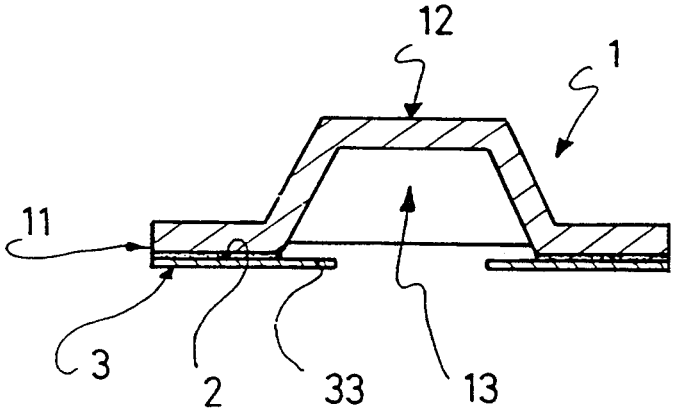
FIG. 2 is a transverse section of the guiding rib of FIG. 1.

Each protective sheet 3 is arranged, in relation to the adhesive means 2 in a manner projecting towards the interior of the hollow part 13 delimited by the protruding part 12 of the guiding rib 1 (in FIGS. 1 and 2). This projecting part 33 of the sheet 3 facilitates grasping of the protective sheet 3 by the user, and thus facilitates its removal. This arrangement also has the advantage of avoiding any projection of protective sheets 3 towards the exterior of guiding rib 1, and thus avoids an untimely removal of the protective sheets 3.

Figure 3:
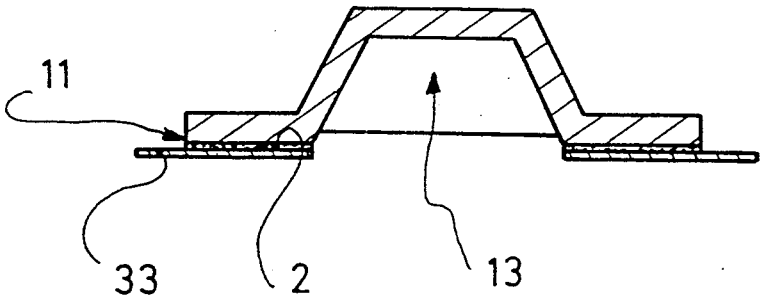

FIG. 3 presents a potential construction where each protective sheet 3 projects towards the outside of the guiding rib 1 in a transverse direction.

Figure 10:
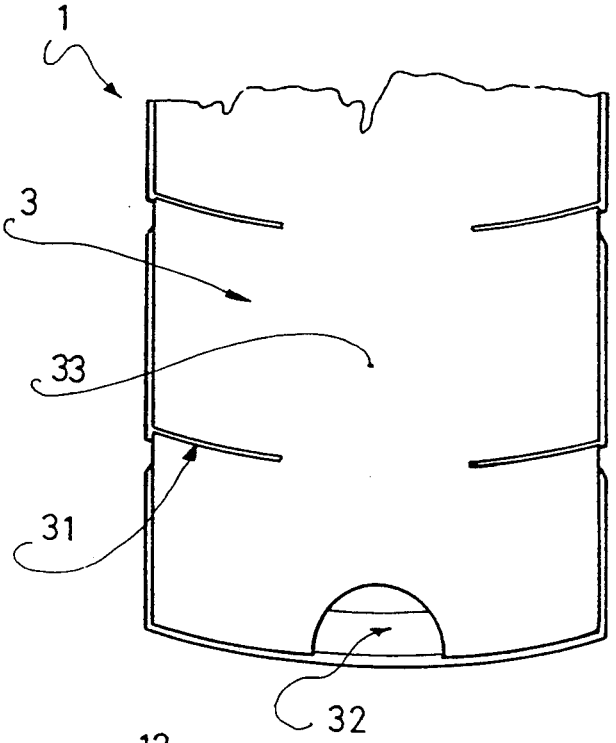

Another construction is illustrated in FIG. 4 in which a single protective sheet 3 covers two adhesive strips arranged on each side of the hollow part 13 of the guiding rib 1. This construction has the advantage of enabling the removal of the protective sheets 3 with a single gesture from the two support surfaces 11. In this case, the projections 33 of the protective sheet 3, in order to facilitate its gripping occur in the longitudinal direction of the rib 1 (FIG. 10). A scalloping 32 can also be formed at the end of the protective sheet 3, so as to remove it easily (FIG. 10).

FIGS. 5–7 illustrate variations of constructions in the case of a solid guiding rib 10. In this case, the adhesive means 2 can extend along the entire support surface 11 of the guiding rib 10. The protective sheet 3 can then have a projecting part 33 on at least one of the edges (FIG. 5) or one of the ends (FIGS. 6 and 7) of the guiding rib 10.

FIGS. 8 and 9 show construction forms of the present invention the case of a divisible guiding rib 1, that is includes at least one transverse groove 14 constituting a zone of lesser resistance 15 permitting the guiding rib to be easily broken off to adapt to the shoe size of the user.

To adapt the adhesive means 2 to such a type of guiding rib 1, various problems occur when the guiding rib 1 is broken off to adapt the rib to the shoe size, and it is difficult to obtain a clean break of the adhesive 2 on each side of the break in the guiding rib 1. In effect, "tearing" of adhesive means 2 is produced, which produces an undesirable retraction or projection of the adhesives in relation to the guiding rib 1.

This problem is resolved by providing, on the adhesive means 2, a transverse indentation 21 extending essentially the length of each transverse groove 14 of the guiding rib 1 (FIGS. 8 and 9). Each transverse indentation 21 creates the beginning of a break in the adhesive means 2 when the guiding rib 1 breaks. This beginning break permits one to obtain a clean cut in the adhesive means 2 when the guiding rib 1 breaks. Thus, the undesirable projection or retraction of the adhesive 2 in relation to the shortened guiding rib 1 is advantageously eliminated.

It is advantageous that each transverse indentation 21 be made in the entire thickness of each double-faced adhesive strip 2 to have a clean cut in each strip 2, and to avoid any tearing when the guiding rib 1 breaks.

As seen in FIGS. 8 and 9, the transverse indentations 21 preferably also extend the whole width of the adhesive means 2, in a direction transverse to the rib 1, which assures the clean cut of the adhesive 2.

As seen in FIG. 8, the transverse indentations 31 are also made in each protective sheet 3, corresponding with the indentations 21 of the adhesive strips 2, these indentations 31 being interrupted in the projecting part 33 of each protective sheet 3.

These transverse indentations 31 in each protective sheet 3 are made, for example by a knife, simultaneously in the indentations 21 of each associated adhesive strip 2, after putting the adhesive strips 2 and the protective sheets 3 on the rib 1.

The interruption of each of these transverse indentations 31 in the protective sheet 3, in the projecting part 33 of this sheet 3, allows a continuous part 33 of the protective sheet 3 to be obtained.

This continuous projecting part 33 of each protective sheet 3 permits, in the case where one does not want to break off the guiding rib 1 to shorten it, to remove each protective sheet 3 in a single gesture to free the associated adhesive strips 2.

Figure 11:
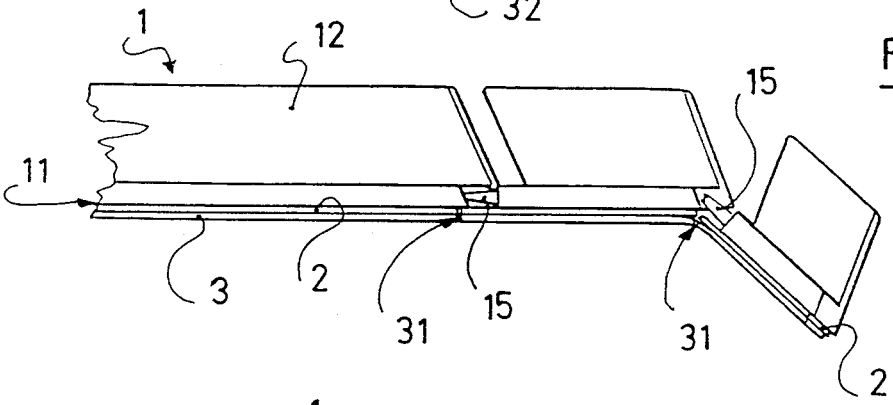
FIG. 11 is a side view of a divisible guiding rib according to the invention in the rupture phase.
Figure 12:
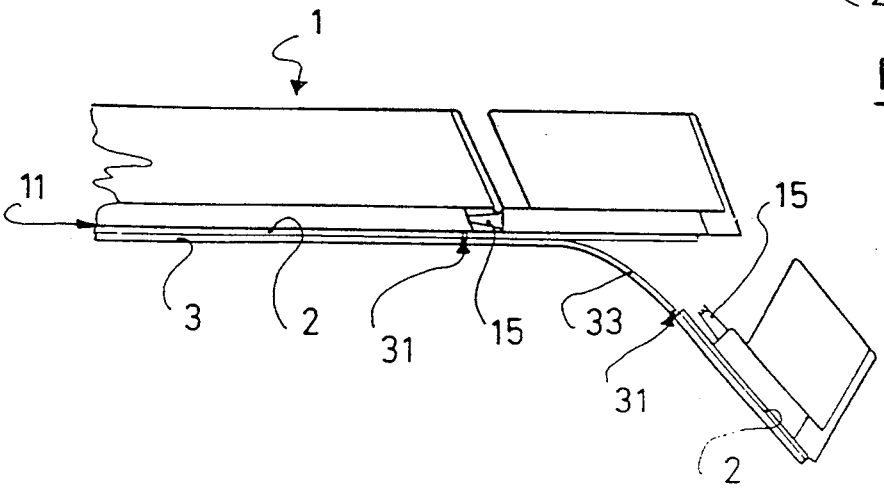
FIG. 12 is a side view of the divisible guiding rib according to the invention in the protective sheet retraction phase.

Also when the rib 1 breaks, this continuous part 33 of each protective sheet 3 allows the removal of the protective sheet 3, along the entire length of the rib 1, with the same gesture that breaks off the guiding rib 1, as seen in FIGS. 11 and 12.

FIG. 9 also shows the transverse indentations 31 when the protective sheets 3 project in relation to the outside edge of the guiding rib 1. In this case, the continuous and non-indented part 33 of each protective sheet is in the part which projects on the outside of the rib.

FIG. 10 illustrates a form of construction of these indentations in which a single protective sheet 3 covers the two support surfaces 11, a central part 33 of this sheet 3 being situated between the two support surfaces, thus constituting the continuous non-indented part of this protective sheet.

Finally, although the invention has been described with reference of particular means, materials and embodiments, it is to be understood that the invention is not limited to the particulars disclosed and extends to all equivalents within the scope of the claims.

What is claimed is:

1. Lateral guiding rib for a cross-country ski boot comprising at least one support surface for affixing said lateral guiding rib against an upper surface of a ski, wherein said at least one support surface comprises adhesive means for affixing said at least one support surface on the upper surface of the ski, and wherein said adhesive means are covered before placement of said guiding rib on the ski by at least one removable protective sheet, said at least one removable protective sheet having at least one part overhanging said adhesive means, and said guiding rib comprising at least one hollow part which is contiguous with at least one said support surface, wherein said protective sheet of said at least one support surface contiguous to said hollow part has an overhanging part overhanging inside said hollow part.

2. Lateral guiding rib according to claim 1, comprising at least one transverse groove constituting a zone of lesser resistance, wherein said adhesive means of said at least one support surface includes at least one transverse indentation extending substantially along and substantially he entire length of said at least one transverse groove.

3. Lateral guiding rib according to claim 1, wherein said at least one protective sheet is a paper strip.

4. Lateral guiding rib according to claim 1, wherein said at least one protective sheet is made from a plastic film.

5. Lateral guiding rib according to claim 1, wherein said adhesive means is a double-faced adhesive strip.

6. Lateral guiding rib according to claim 1, wherein said overhanging part of said protective sheet overhangs on the outside of said guiding rib.

7. Lateral guiding rib for a cross-country ski boot comprising at least one support surface for affixing said lateral guiding rib against an upper surface of a ski, wherein said at least one support surface comprises adhesive means for affixing said at least one support surface on the upper surface of the ski, and wherein said adhesive means are covered before placement of said guiding rib on the ski by at least one removable protective sheet, said at least one removable protective sheet having at least one part overhanging said adhesive means, and at least one transverse groove constituting a zone of lesser resistance, wherein said adhesive means of said at least one support surface includes at least one transverse indentation extending substantially along and substantially the entire length of said at least one transverse groove.

8. Lateral guiding rib according to claim 7, said guiding rib comprising at least one hollow part which is contiguous with at least one said support surface, wherein said protective sheet of said at least one support surface contiguous to said hollow part has an overhanging part overhanging inside said hollow part.

9. Lateral guiding rib according to claim 7, wherein said at least one transverse indentation extends substantially the entire width of said adhesive means.

10. Lateral guiding rib according to claim 7, wherein said at least one protective sheet of said adhesive means includes at least one transverse indentation substantially coinciding with a respective transverse indentation in said adhesive means.

11. Lateral guiding rib according to claim 10, wherein said at least one transverse indentation in said protective sheet is interrupted in said overhanging part of said protective sheet.

12. Lateral guiding rib according to claim 10, wherein said indentation of said protective sheet and a respective indentation of said adhesive are simultaneously formed.

* * * * *